United States Patent [19]

Stumpp et al.

[11] 4,090,486

[45] May 23, 1978

[54] FUEL INJECTION SYSTEM

[75] Inventors: Gerhard Stumpp; Hermann Grieshaber, both of Stuttgart, Germany

[73] Assignee: Robert Bosch GmbH, Stuttgart, Germany

[21] Appl. No.: 721,896

[22] Filed: Sep. 9, 1976

[30] Foreign Application Priority Data

Oct. 7, 1975 Germany ..... 2544800

[51] Int. Cl.[2] ..... F02M 39/00; F02D 1/06

[52] U.S. Cl. ..... 123/139 AW; 123/140 MC; 123/119 R; 261/50 A; 123/140 MP

[58] Field of Search ..... 123/139 AW, 140 MC, 123/119 R; 261/50 A

[56] References Cited

U.S. PATENT DOCUMENTS

| | | | |
|---|---|---|---|
| 3,696,798 | 10/1972 | Bishop et al. | 123/119 R |
| 3,736,912 | 6/1973 | Okura et al. | 123/139 AW |
| 3,866,583 | 2/1975 | Pundt et al. | 123/139 AW |
| 3,927,649 | 12/1975 | Stumpp | 123/139 AW |
| 3,983,856 | 10/1976 | Stumpp et al. | 123/139 AW |

*Primary Examiner*—Charles J. Myhre
*Assistant Examiner*—P. S. Lall
*Attorney, Agent, or Firm*—Edwin E. Greigg

[57] ABSTRACT

A fuel injection system for externally ignited internal combustion engines in which a fuel metering and distributing valve is controlled by an air sensing element disposed in the air suction tube of the engine and by structure which is adapted to alter the restoring force exerted on the air sensing element through the fuel metering and distributing valve. The noted structure includes a control pressure conduit, a pressure control valve connected to the control pressure conduit and a further conduit for connecting the pressure control valve to the suction tube of the engine downstream of the butterfly valve. With this structure it is possible to alter the restoring force mentioned above so that a properly proportioned fuel-air mixture is achieved, and in particular, so that a properly enriched fuel-air mixture is achieved during full load operation.

4 Claims, 1 Drawing Figure

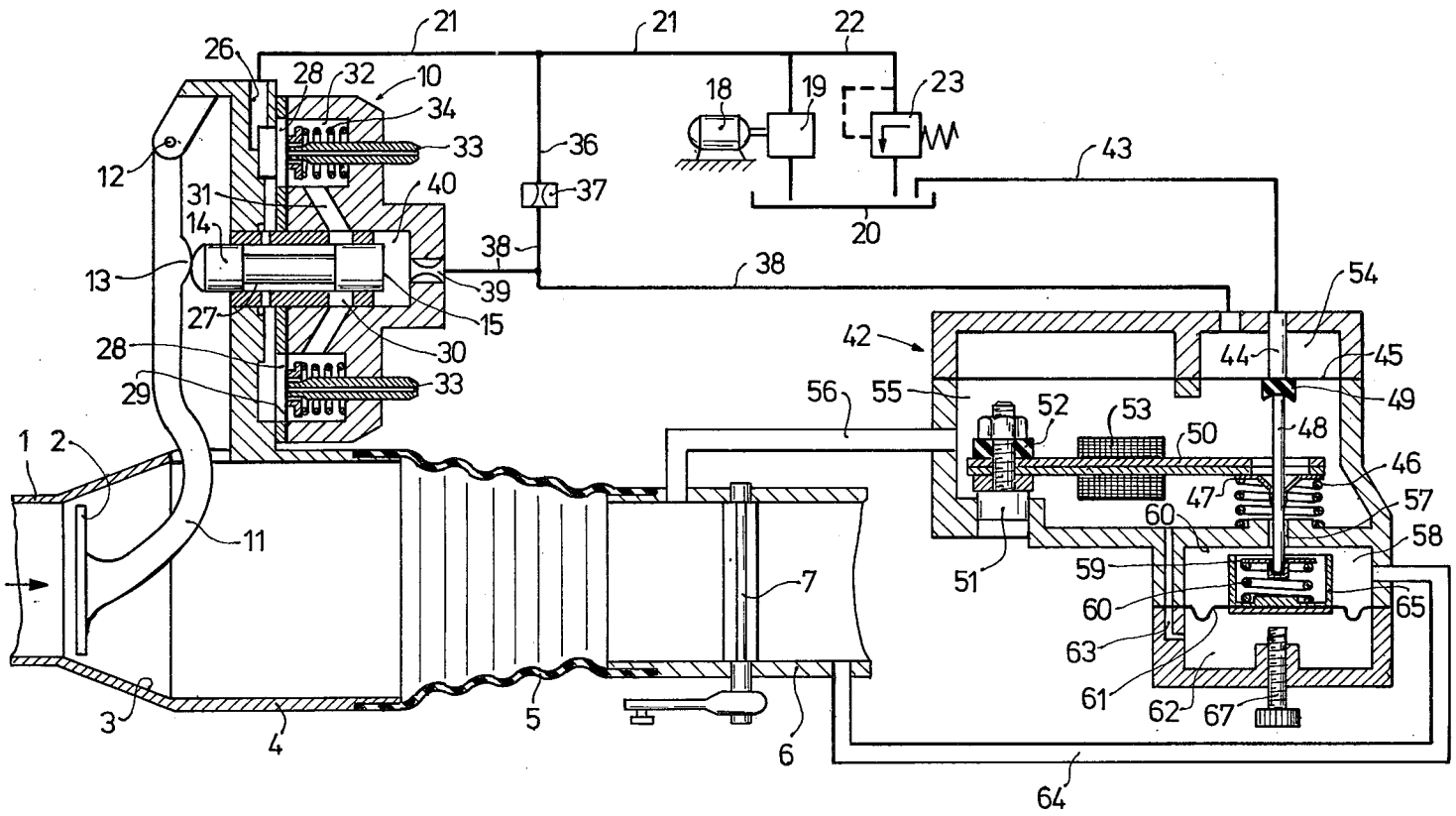
1
2
3
4
5
6
7
10
11
12
13
14
15
18
19
20
21
22
23
26
27
28
29
30
31
32
33
34
36
37
38
39
40
42
43
44
45
46
47
48
49
50
51
52
53
54
55
56
57
58
59
60
61
62
63
64
65
67

FUEL INJECTION SYSTEM

BACKGROUND OF THE INVENTION

The present invention relates to a fuel injection system for an externally ignited internal combustion engine which operates on fuel which is continuously injected into the suction tube in which a sensor element and an arbitrarily operable butterfly valve are disposed in series. The sensor element is moved by and in proportion to the quantity of air flowing through the pipe against a restoring force. In the course of its excursion, the sensor element displaces a movable component of a valve disposed in the fuel supply line for metering a proportionate quantity of fuel to air. The afore-mentioned restoring force is supplied by liquid under pressure which is delivered continuously under constant, but arbitrarily variable pressure through a control pressure line and which exerts a force on a control plunger transferring the restoring force. The pressure of said liquid is variable by at least one pressure control valve controllable as a function of the engine parameters. The pressure control valve is in the form of a flat seat valve comprising a valve membrane as the movable valve part.

Fuel injection systems of this type are designed to automatically provide a good fuel-air mixture for all operating conditions of the internal combustion engine so as to burn the fuel as completely as possible and thus while obtaining maximum performance of the internal combustion engine, with minimum fuel consumption, to prevent toxic exhaust gases from being produced, or at least to reduce considerably the same. The quantity of fuel, therefore, must be metered very accurately in accordance with the requirements of each operational state of the internal combustion engine.

In the case of known fuel injection systems of this type, the quantity of fuel which is metered is, as far as possible, proportionate to the quantity of air flowing through the suction tube. The ratio of the quantity of fuel which is metered to the quantity of air may be varied by changing the restoring force of the sensing element as a function of the operating parameters by means of an electromagnetically actuated pressure control valve.

It has been found that it is advantageous to momentarily enrich the fuel-air mixture when the throttle valve (butterfly valve) is suddenly opened and to weaken momentarily the fuel-air mixture when the throttle valve is suddenly closed.

OBJECT AND SUMMARY OF THE INVENTION

The principal object of the present invention is to produce a fuel injection system of the known type, by means of which the fuel-air mixture is momentarily enriched or weakened during load changes of the internal combustion engine.

This object and others are accompolished according to the present invention in that for the purpose of changing the fuel-air ratio during load changes, a pressure control valve is provided which comprises two pressure chambers separated by a control membrane. The first of these pressure chambers is in communication with the suction tube downstream of a throttle valve which is mounted in the suction tube via a pressure conduit, while the second pressure chamber communicates with the first pressure chamber via a throttle bore. The spring chamber communicates with the suction tube between the sensor element and the butterfly valve via a pressure conduit. A control spring acting on the control membrane is disposed in the second chamber and a valve spring acting on a valve membrane is disposed in the first chamber with a connecting element being disposed between the valve membrane and the control membrane.

An advantageous feature of the present invention results from the arrangement of the transmission pin being adopted to project through the choke bore into the first pressure chamber.

Yet another advantageous feature of the invention is in the displacement of the control membrane which is adapted to be limited by stops.

Still another advantageous feature of the invention consists in that, at temperatures below the operating temperature of the engine, the closing force exerted on the valve membrane may be reduced by an electrically heatable bi-metallic valve spring.

A preferred embodiment of the invention is represented in the drawing and will be described in detail hereinafter.

BRIEF DESCRIPTION OF THE DRAWING

The sole FIGURE illustrates a fuel injection system according to a preferred embodiment of the present invention including the structure for varying the fuel-air ratio of the fuel mixture delivered to the engine during engine load changes.

DESCRIPTION OF THE PREFERRED EMBODIMENT

In the fuel injection system illustrated, the combustion air first flows through an air filter (not shown) in the direction of the arrow through a suction tube portion 1, in which a sensor 2 is disposed in a conical position 3. From the conical portion the air flows in a suction tube portion 4 and thereafter through a coupling hose 5 into a suction tube portion 6 in which there is disposed an arbitrarily operable throttle valve (butterfly valve) 7. From the latter the combustion air flows to one or more cylinders (not shown) of an internal combustion engine. The sensor 2 consists of a plate disposed at right angles to the direction of flow and is displaced in the conical suction tube portion 3 as an approximately linear function of the air flowing through the suction tube. Given a constant restoring force exerted on the sensor 2 as well as a constant air pressure prevailing upstream of the air sensor 2, the pressure prevailing between the air sensor 2 and the throttle valve 7 also remains constant.

The sensor 2 directly controls a metering and distributing valve 10. For the transmission of the motion of the sensor 2 there is provided a lever 11 which is connected to the air sensor at one end and pivotably mounted by a pivot point 12 at the other end. The lever 11 is provided with a nose 13 and during the pivoting movement of the lever 11 the nose 13 actuates the movable part 14 which forms part of the metering and distributing valve 10. The slide member 14 serves as a control plunger including a front face 15, which is remote from the nose 13. The front face 15 is exposed to the force of pressurized liquid. The pressure of this liquid acting on the face 15 produces the restoring force on the air sensor 2.

Fuel is supplied by means of a fuel pump 19 which is driven by an electric motor 18 and which draws fuel from a fuel tank 20 and delivers it through a conduit 21 to the fuel metering and distributing valve 10. From the conduit 21 there extends a conduit 22 in which is disposed a pressure limiting valve 23. When there is excessive pressure in the system the pressure limiting valve allows fuel to flow back into the fuel tank 20.

From the conduit 21 the fuel is admitted into a channel 26 provided in the housing of the fuel metering and distributing valve 10. The channel 26 leads through several branch conduits to the chambers 28, such that the one side of a membrane 29 is exposed to fuel pressure. Dependent upon the axial position of the control plunger 14, the annular groove 27 overlaps and as a result opens to a greater or lesser extent the control slots 30 which lead through channels 31 to chambers 32. Each of the latter is separated from a corresponding chamber 28 by means of a membrane 29. From the channels 32 the fuel is admitted through injection channels 33 to the individual fuel injection valves (not shown) which are positioned in the suction tube in the vicinity of a corresponding engine cylinder. The membrane 29 serves as the movable part of a flat seat valve which, when the fuel injection system is inoperative, is maintained open by means of springs 34. The membrane boxes, each formed of a chamber 28 and 32, ensure that, independently of the overlap between the annular groove 27 and the control slots 30 that is, independently from the quantity of fuel flowing to the fuel injection valves, the pressure drop at the fuel metering valves 27, 30 remains substantially constant. In this way, it is ensured that the extent of displacement of the control plunger 14 and the metered fuel quantity are proportionate to one another.

Upon a pivotal movement of the lever 11, the sensor 2 is moved in the conical section 3 of the suction tube and, as a result, the annular flow passage section between the sensor and the cone changes generally in proportion to the extent of the displacement of the sensor 2.

The liquid producing the constant restoring force on the control plunger 14 is fuel. For this purpose, from the conduit 21 there extends a conduit 36 which is separated from a pressure control conduit 38 by means of an uncoupling throttle 37. A pressure chamber 40 communicates with the pressure control conduit 38 via a damping throttle 39. The front face 15 of the control plunger 14 projects into the pressure chamber 40.

A pressure control valve 42 is disposed in the control pressure conduit 38. The pressurized fluid can pass to the fuel tank 20 through a depressurized return conduit 43 via the pressure control valve 42. The pressure of the pressurized liquid producing the restoring force can be varied in a temperature-dependent manner and in dependence on the pressure drop at the butterfly valve 7 by means of the pressure control valve 42. The pressure control valve 42 is in the form of a flat seat valve having a stationary valve seat 44 and a valve membrane 45 which is bias-loaded in the closing direction of the valve, inter alia, by a spring 46. The valve spring 46 exerts pressure on the valve membrane 45 via a spring rest 47 and a pin 48 which is connected to the latter and which is supported on a bearing 49. At temperatures below the engine operating temperature the closing force transmitted to the pressure control valve 42 by the valve pin 48 works against a bi-metallic spring 50 which, during the warm-up stage, rests at its one end against the spring rest 47 and the other end of which is secured by means of a bolt 51 pressed into the housing of the pressure control valve 42. The bi-metallic spring 50 is largely protected against losing heat to the housing of the pressure control valve my means of an insulating element 52 disposed between the bolt 51 and the bi-metallic spring 50. An electric heater 53, which is energized in a conventional manner, is mounted on the bi-metallic spring 50.

The valve membrane 45 separates a control pressure chamber 54 from a spring chamber 55 which is connected to the suction tube 4, 5 between the sensor 2 and the butterfly valve 7.

The transmission pin 48 disposed in the spring chamber 55 includes an end remote from the valve membrane 45 which projects through a throttle bore 57 into a first pressure chamber 58. The throttle bore 57 is disposed in a wall of the pressure control valve 42 which separates spring chamber 55 from the first pressure chamber 58. The diameter of the pin 48 is such as to permit the friction-free displacement of the pin 48 relative to the bore 57. In the first pressure chamber 58 the transmission pin 48 is supported via a spring rest 59 on a control spring 60 the spring force of which is determined by the position of a control membrane 61 that separates the first pressure chamber 58 from a second pressure chamber 62 which communicates via conduit 63 with the spring chamber 55 and thus with the suction tube between the sensor 2 and the butterfly valve 7. The first pressure chamber 58 communicates, on the one hand, with the suction pipe region 6 downstream of the throttle 7, via a pressure line 64 and, on the other hand, with the spring chamber 55 via the throttle bore 57. The diameter of the throttle bore 57. The diameter of the throttle bore 57 is kept sufficiently small for the idling rate to be sufficiently low. The displacement of the control membrane 61 can be limited, on the one hand, in an upward direction by the abutment of a collar 65 against the limiting wall 66 of the first pressure chamber 58 and, on the other hand, its movement can be limited in a downward direction by the abutment of the control membrane against a stop 67, which can consist, for example, of a screw, and which can be arbitrarily adjustable.

The fuel injection system operates in the following manner: when the internal combustion engine is running, fuel is drawn from the tank 20 by the pump 19 driven by the electric motor 18 and forced through the conduit 21 to the fuel metering and distributing valve 10. At the same time, the internal combustion engine draws air through the suction pipe 1 and, as a result, the air sensor 2 undergoes a certain excursion from its rest position. In response to the deflection of the sensor 2, the control plunger 14 is displaced via the lever 11 and thus the flow passage section at the control slot 30 is increased. The direction connection between the sensor element 2 and the control plunger 14 ensures a constant ratio between the quantity of air and the metered quantity of fuel provided the characteristics of these two components are sufficiently linear (which is desideratum by itself). In such a case, the fuel-air ratio would be constant for the entire operational range of the engine. However, it is necessary for the fuel-air mixture to be richer or leaner depending on the operational conditions and this is achieved by varying the restoring force acting on the sensor 2. For this purpose there is provided in the control pressure conduit 38 the pressure control valve 42 which, by influencing the pressure of the pressurized liquid during the warm-up phase of the internal combustion engine, influences the fuel-air ratio as a function of the temperature and during load changes, until the operating temperature of the internal combustion engine is reached. The control pressure is determined by the closing force transmitted to the valve membrane 45 by the valve pin 48. However, at temperatures below the operating temperature of the internal combustion engine the bi-metallic valve spring 50 exerts a force against the spring rest 47 against the force of the valve spring 46 and the control spring 60, thereby reducing the closing force exerted on the membrane 45. However, immediately after the engine is started, the bi-metallic valve spring 50 is heated by means of the electric heater element 53 which results in a reduction in the force transmitted by the bi-metallic spring 50 onto the spring rest 47. The requisite initial biasing of the spring 50 can be achieved by pressing the bolt 51 to a varying depth in the housing of the pressure control valve 42.

When the internal combustion engine is suddenly accelerated according to the invention, the pressure of the pressurized fluid in the control pressure conduit is reduced for the purpose of obtaining an acceleration fuel quantity in addition to the quantity of fuel metered at the metering and distributing valve 10 in dependence on the quantity of air drawn in, thus enabling a richer fuel-air mixture to be obtained. As a result of a reduction in the pressure of the pressurized liquid in the control pressure conduit 38, the restoring force exerted on the sensor 2 is reduced and, as a result, while the throughgoing quantity of air remains constant, the deflection of the sensor element and thus of the control plunger 14 is more extensive, whereupon an increase quantity of fuel is metered at the metering valve 27, 30.

The reduction in the pressure of the pressurized liquid in the control pressure conduit 38 occurs as a result of the fact that when there is sudden acceleration of the internal combustion engine the pressure in the suction tube section 6 downstream of the throttle valve 7, increases thereby producing a pressure difference at the control membrane 61. This pressure difference results in a reduction of the force of the control spring 60 on the transmission pin 48 and thus of the closing force exerted on the membrane 45. During full-load operation the control membrane 61 rests against the stop 67.

If there is a reduction in the suction tube pressure downstream of the butterfly valve 7 when the butterfly valve is in the partial load position, a pressure difference is produced at the control membrane 61 which leads to an increase in the force of the control spring 60 and thus of the closing force exerted on the valve membrane 45 whereupon the control pressure in the control pressure line 38 increases and a reduced quantity of fuel is metered at the metering valves 27, 30. This results in a leaner fuel-air mixture in the partial load range than in the full load range.

What is claimed is:

1. A fuel injection system for externally ignited internal combustion engines comprising, in combination:

(a) a suction tube for air intake to the engine;
(b) an air sensor disposed in said suction tube;
(c) an arbitrarily operable butterfly valve disposed in said suction tube in series with said air sensor;
(d) a fuel supply conduit;
(e) a control pressure conduit;
(f) a fuel metering valve connected to said fuel supply conduit and said control pressure conduit for continuously injecting fuel into said suction tube;
(g) a control plunger, serving as the movable member of said fuel metering valve, said control plunger being acted upon on one end by said air sensor, and on an opposite end by a return force provided by liquid under constant but arbitrarily variable pressure delivered by said control pressure conduit, for metering a fuel quantity that is proportionate to the quantity of air measured by said air sensor; and
(h) at least one pressure control valve in the form of a flat seat valve having a membrane as the movable valve part, said pressure control valve being disposed in said control pressure conduit for varying pressure in said control pressure conduit in dependence on at least one operating parameter of the engine and thereby varying the fuel-air ratio during load changes, and in particular for enriching the fuel-air mixture during full load operation, wherein the pressure control valve includes:
(i) a valve membrane;
(ii) a control membrane;
(iii) two pressure chambers separated from one another by the control membrane;
(iv) a pressure conduit connected to a first one of the pressure chambers and to the suction tube downstream of the butterfly valve;
(v) a spring chamber;
(vi) means defining a throttle bore within the pressure control valve for connecting the spring chamber to the first one of the pressure chambers;
(vii) a further pressure conduit connected to the spring chamber and to the suction tube between the air sensor and the butterfly valve;
(viii) another pressure conduit connected to a second one of the pressure chambers and to the spring chamber;
(ix) a control spring disposed in the first one of the pressure chambers, said control spring acting against the control membrane;
(x) a valve spring disposed in the spring chamber, said valve spring acting against the valve membrane; and
(xi) a transmission pin disposed between the valve membrane and the control membrane.

2. The fuel injection system as defined in claim 1, wherein the transmission pin projects through the throttle bore into the first one of the pressure chambers.

3. The fuel injection system as defined in claim 1, wherein the pressure control valve further includes limit stops on either side of the control membrane, and wherein the displacement of the control membrane is limited by said stops.

4. The fuel injection system as defined in claim 1, wherein the pressure control valve further includes an electrically heatable bi-metallic spring, and wherein at temperatures below the engine operating temperature, the closing force exerted on the valve membrane can be reduced by means of the electrically heatable bi-metallic spring.

* * * * *